US008654990B2

(12) United States Patent
Faller

(10) Patent No.: US 8,654,990 B2
(45) Date of Patent: Feb. 18, 2014

(54) MULTIPLE MICROPHONE BASED DIRECTIONAL SOUND FILTER

(75) Inventor: Christof Faller, St-Sulpice (CH)

(73) Assignee: Waves Audio Ltd., Tel Avir (IL)

( * ) Notice: Subject to any disclaimer, the term of this patent is extended or adjusted under 35 U.S.C. 154(b) by 257 days.

(21) Appl. No.: 13/147,940

(22) PCT Filed: Feb. 9, 2010

(86) PCT No.: PCT/IL2010/000113

§ 371 (c)(1),
(2), (4) Date: Aug. 4, 2011

(87) PCT Pub. No.: WO2010/092568

PCT Pub. Date: Aug. 19, 2010

(65) Prior Publication Data

US 2011/0286609 A1 Nov. 24, 2011

Related U.S. Application Data

(60) Provisional application No. 61/151,030, filed on Feb. 9, 2009.

(51) Int. Cl.
*H04R 3/00* (2006.01)

(52) U.S. Cl.
USPC ..... 381/92; 381/91; 381/94.1; 381/94.2; 381/94.3; 381/122; 381/313; 381/317; 700/94

(58) Field of Classification Search
USPC ..... 381/92, 91, 94.1, 94.2, 94.3, 122, 313, 381/317; 700/94
See application file for complete search history.

(56) References Cited

U.S. PATENT DOCUMENTS

| | | | | |
|---|---|---|---|---|
| 6,751,325 | B1 * | 6/2004 | Fischer | 381/313 |
| 6,871,106 | B1 * | 3/2005 | Ishikawa et al. | 700/94 |
| 2007/0223740 | A1 * | 9/2007 | Reams | 381/119 |
| 2008/0037799 | A1 * | 2/2008 | Yarygin et al. | 381/63 |
| 2008/0089523 | A1 * | 4/2008 | Roeck | 381/23.1 |

FOREIGN PATENT DOCUMENTS

JP A-2005-244813 9/2005

OTHER PUBLICATIONS

Faller, Christof, "Multiple-Loudspeaker Playback of Stereo Signals," *Journal of the Audio Engineers Society*, vol. 54, No, 11, pp. 1051-1064, Nov. 2006.

Van Veen et al., "Beamforming: A Versatile Approach to Spatial Filtering," *IEEE ASSP Magazine*, pp. 4-24, Apr. 1988.

Frost, Otis Lamont, "An Algorithm for linearly constrained adaptive array processing," *Proceedings of the IEEE*, vol. 60, issue 8, Aug. 1972 (Abstract Only).

Favrot et al., "Perceptually Motivated Gain Filter Smoothing for Noise Suppression," *Audio Engineering Society (AES) Convention Paper 7169 presented at the AES 123rd Convention*, New York, NY, USA, pp. 1-8, Oct. 5-8, 2007.

International Search Report issued in Application No. PCT/IL2010/000113; Dated Jun. 1, 2010.

* cited by examiner

*Primary Examiner* — Vivian Chin
*Assistant Examiner* — Paul Kim
(74) *Attorney, Agent, or Firm* — Oliff & Berridge, PLC

(57) ABSTRACT

A system and method for use in filtering of an acoustic signal are provided for producing an output signal of attenuated amount of diffuse sound in accordance with predetermined parameters of desired output directional response and required attenuation of diffuse sound. The system includes a filtration module and a filter generation module including a directional analysis module and filter construction module.

22 Claims, 9 Drawing Sheets

MULTIPLE MICROPHONE BASED DIRECTIONAL SOUND FILTER

FIELD OF THE INVENTION

The present invention is generally in the field of filtering acoustic signals and relates to a method and system for filtering acoustic signals from two or more microphones.

REFERENCES

The following references are considered to be pertinent for the purpose of understanding the background of the present invention:

[1] C. Faller, "Multi-loudspeaker playback of stereo signals," J. of the Aud. Eng. Soc., vol. 54, no. 11, pp. 1051-1064, November 2006.

[2] Barry D. Van Veen and Kevin M. Buckley—Beam Forming, a Versatile approach to spatial filtering, IEEE ASSP, April 1988, pages 4-24.

[3] Otis Lamont Frost—An algorithm for linearly constraint adaptive array processing, Proc. Of IEEE, vol. 60, number 8, 1972.

[4] Alexis Favrot and Christof Faller—"Perceptually Motivated Gain Filter Smoothing for Noise Suppression", Audio Engineering Society (AES) Convention Paper 7169 presented at the AES 123$^{rd}$ Convention, New York, N.Y., Oct. 5-8 2007.

BACKGROUND OF THE INVENTION

Noise suppression techniques are widely used for reducing noise in speech signals or for audio restoration. Most noise suppression algorithms are based on spectral modification of an input audio signal. A gain filter is applied to the short-time spectra of an audio signal received from an input channel, producing an output signal with reduced noise.

The gain filter is typically a real-valued gain computed per each time-frequency tile (time-slot (window) and frequency-band (BIN)) of said input signal in accordance with an estimate of the noise power in the respective time-frequency tile. The accuracy of the estimation of the amount of noise in the different time-frequency tiles has a crucial effect on the output signal. While under-estimation of the amount of noise in each tile may result in a noisy output signal, over-estimating the amount of noise or having inconsistent estimations introduces various artifacts to the output signal.

Although it is highly desirable to reduce noise in speech and audio signals, noise suppression is a trade-off between the degree of noise reduction and artifacts associated therewith. Generally, the degree of artifacts in the output signal depends on the accuracy of the noise estimation and the degree of noise reduction sought. The more noise is to be removed, the more likely are artifacts due to aliasing effects and time variance of the gain filter. However, as the estimation of noise in the input signal is more accurate, a higher degree of noise reduction can be obtained without increasing the artifacts associated therewith. Reference [4] is an example of a gain filtering technique for noise suppression proposed by the inventor of the present invention.

There are many techniques for the estimation of the amount of noise in the input signal. Most of those techniques are based on some assumptions relating to the nature of the input signal, the desired output signal or the noise. For example, one such technique is based on the assumption that the power of the noise component in the input signal is generally lower than the pure signal to be obtained. Accordingly, time frequency tiles having a lower power (e.g. below a certain threshold) are considered as noisy and are therefore suppressed. According to another technique, the noise reduction filter is targeted at enhancing and suppressing certain spectral bands (e.g. speech/voice related bands) which are considered as associated with the desired input signal and noise, respectively.

In accordance with another method proposed by the inventor of the present invention, the amount of noise is estimated by determining "noisy" time frames that include only noise (e.g. using a voice activity detector, VAD). In this case, the power of noise in each time-frequency tile of the preceding and/or following time frames (in which voice is detected) is estimated based on the power of the corresponding tiles of the "noisy" time frames.

Some techniques utilize directional beam forming for enhancing the sound of a particular sound source from a particular direction over other sounds, in acoustic situations in which multiple sound sources exist. Generally, according to these techniques, the input signals received from multiple microphones are combined with proper phase delays so as to enhance the sound components arriving at the microphones from certain directions. This allows the separation of sound sources, the reduction of background noise, and the isolation of a particular person's voice from multiple talkers surrounding that person.

Directional beam forming can be performed utilizing input signals received from an array of multiple microphones which may be omni-directional microphones (or not highly directional). Many types of multiple microphone directional arrays have been constructed in the past 50 years, as is described for example in references [2] and [3].

Multi-microphone arrays are also characterized by a trade-off between the enhancement of source-signal-to-background-noise, and the accuracy at which the direction of a sound source is determined. While delay-and-subtract methods, sometimes referred to as virtual cardioids, yield wide directional beams and a poor source-signal-to-background-noise ratio, adaptive-filter beam-formers can get narrow beams pointing at an exact direction of a sound source, only if the direction of the sound source is known and tracked precisely. At the same time, widening the beam also makes the algorithms sensitive to room reflections and reverberation.

GENERAL DESCRIPTION

There is a need in the art for a novel filtering technique capable of high SNR filtering of an acoustic signal from an input channel for suppressing background noises and enhancing foreground acoustic signals in the acoustic field received through such a channel. Nowadays, various electronic devices such as cellular phones, lap-top computers, telephones and teleconferencing devices, are equipped with two or more microphones, and their signals need to be processed to enhance signal foreground to background noise ratio and improve intelligibility by the far end listener.

Existing techniques for enhancing signal to noise ratio in an input signal may be generally categorized as: "Beam Forming" techniques which utilize microphone phase array, namely combine signal inputs from multiple channels (associated with multiple microphones) with appropriate delays (e.g. phase delay) into an output signal of enhanced directional response; and "Noise Suppression" techniques in which the output signal is typically generated by a noise filtration scheme applied to a single input signal.

Noise Suppression techniques and systems are generally based on modeling of the input signal y as y[n]=x[n]+v[n], i.e. as a sum of a foreground signal x that is to be enhanced/preserved and a background signal v (noise) that is to be filtered (n is the time sample index). Noise filtration is based on noise estimation schemes, according to which the power of noise in the input signal is typically selected in accordance with the particular application and nature of the sound field for which noise suppression/reduction is sought.

Existing noise suppression techniques do not provide adequate noise estimation methods/algorithms enabling high SNR output to be obtained, and the performance of noise suppression techniques thus deteriorates. Existing noise estimation methods are typically designed for specific applications, such as speech enhancement. These methods generally rely on assumptions about the signal, which serve as a basis for the estimation of the amount of noise in each time frame and in each frequency band.

"Beam Forming" is generally aimed at providing an output signal with enhanced directional sensitivity to sound from sound sources located in particular direction(s). This is achieved by super-positioning input signals from two or more audio channels summed or subtracted with appropriate delays and amplification factors. The delays and amplification factors are designed according to the set up of the perception system (directivity and locations of microphones) such that the summed output signal has a higher sensitivity to signals arriving at the perception system from certain desired direction(s). Generally according to these techniques input signals from the one or more channels corresponding to sound from the desired direction(s) are superimposed in phase and thus amplified, while signals corresponding to sound from outside of the desired direction(s) are superimposed out of phase and suppressed.

The perception system of a typical beam forming application utilizes an array of microphones. In order to reduce cost and to reduce the amount of processing, it is desirable to minimize the number of microphones (audio channels) used in such arrays. However, since beam forming is related to relation between the distances between microphones and the wavelengths of the acoustic waves perceived by the microphones, performing beam forming utilizing a small number of microphones introduces various artifacts to the output signal, while also posing severe limitations on the frequency range that may be filtered directionally and also on the required processing and sampling rates (corresponding to the spectral band spacing).

For example, considering a beam forming set up including two spaced apart microphones, an input signal of a wavelength much longer than the spacing/distance between the microphones would generate almost identical output signals at both microphones. At very short wavelengths the microphones are noisier and a combined computation becomes inaccurate. At wavelengths in the order of the distance between the microphones, the response becomes very frequency dependent, and it is difficult or even impossible to synchronize the phase of the signals arriving at different microphones. Hence, in a typical beam forming system, reducing the aforementioned artifacts is achieved by utilizing arrays of multiple microphones (more than two) and employing a more powerful processing unit. Beam forming systems are therefore costly and also less suited for use in small devices, such as cell phones, with limited space for the number of microphones and limited processing resources. Another class of artifacts of beam forming techniques stem from the differences between the responses of the different microphone capsules in the array (due to limitations in manufacturing and acoustic installations). These artifacts are inherently generated in the output signal by the superposition of signals from multiple microphones having different responses. The present invention is associated with directional acoustic (in particular sound) filter in which the above artifacts of the beam forming technique are minimized, while enabling a directional response to be achieved utilizing a small number of acoustic (audio) channels (down to two). The invention enables noise suppression from an acoustic signal by determining the operative parameters for directional filtering of said signal by a certain predetermined filter module. The operative parameters are determined in accordance with the predetermined filter module and by utilizing directional analysis of the sound field. Typically the filter module used is an adaptive filter module for which operative parameters (e.g. filter coefficients) are continuously determined for each portion (time frame) of the signal to be filtered. Alternatively, the filter module may be implemented in a short-time spectral or filterbank domain, such as a short-time Fourier transform (STFT) domain. In this case, the operative parameters may be continuously determined for each portion (time-frequency tile) of the signal to be filtered.

Although not limited in this respect, a directional analysis of the sound field may be carried out based on two (or more) acoustic channels (input signals) corresponding to perception of the acoustic field from different directions. The acoustic channels may be obtained (directly or through recordings of input signals) from two or more microphones which have different directional responses and/or from two or more microphones located at different positions with respect to the acoustic field being filtered.

More specifically, the present invention is used for filtering acoustic signals in the audio range and is therefore described below with respect to this specific application. It should however be understood that the invention is not limited to sound related applications.

The invention is based on the understanding that directional analysis of the sound field may provide for accurate directional noise estimation which may optimize the operation of noise suppression systems. More specifically, a parametric directional analysis of the sound field is implemented (as described below), based on the input signals received from two or more channels/microphones. Directional analysis is aimed at determining, with good accuracy, directional characteristics (data) of the sound field including for example the power of diffuse and direct signals in each portion (tile) (associated with particular time-frame and/or particular frequency-band) of the inputs signal and the directions from which direct sounds originate.

In this respect, determining operative parameters for noise reduction filter is carried out utilizing said directional characteristics of the sound field for performing directional noise estimation, with respect to certain desired directions (e.g. for certain desired output directional response) which should be emphasized in the output signal that is obtained after filtration, and is based on the magnitudes of direct and diffuse sounds in the input signals. Generally, portions of the input signals which originate from directions different from said desired directions are considered as noise parts (or diffuse sound components) in the input signal to be filtered and should therefore be attenuated in the filtered output signal. Hence Operative parameters/filter coefficients for noise reduction from the signal to be filtered may be constructed based on the desired output directional response and based on such directions from which direct sounds of originate to reduce/attenuate noise components in the output signal. Typically the operative filter parameters include multiple coefficients associated respectively with the amplification (or suppression) of different portions of such a signal in an output signal.

However, attempting to filter out all or most of the diffuse sound (noise part) from the output signal may result in audible artifacts in the output sound signal. Generally, as more noise is filtered out from the output signal, the higher the levels of artifacts in the signal. Hence according to the invention, in order to enable optimal noise filtering, the operative parameters are constructed in accordance with another parameter designating the required amount of diffuse sound in the output signal. Utilizing this parameter enables optimizing the levels of noise suppression and the levels of filtering artifacts in the output signal. Also, since output signal is obtained by applying noise suppression to any one of the at least two input channels of the system, enables avoiding artifacts which arise when directional noise suppression is based on summation/superposition of multiple input signals (beam forming techniques).

Accordingly, an output signal obtained by the technique of the invention has enhanced directional response without the aforementioned artifacts that result from beam forming of a small number of channels. Also artifacts which are associated with differences in the wavelength sensitivity of the different directional responses are reduced since the output signals from multiple microphones only serve for noise estimation and not for the final generation of the output signal. Also, when utilizing beam forming in the context of the invention for purposes of directional analysis, certain artifacts of the beam forming might be further suppressed by applying a magnitude correction filter to the beam formed signals as described further below.

In this connection, it should be noted that in the context of the present invention, where noise suppression and the determination of said operative parameters are based on directional analysis of the sound field, the terms direct and diffuse sound are used to designate respectively the noiseless part and the noise part of the input signals. Direct sound is considered generally as sound reaching the microphones directly from a source and is typically correlated between the microphones. Diffuse sound is considered as ambient sound, e.g. originating from reflections of direct sounds, and is generally less correlated between the microphones perceiving the sound field. With respect to filtration of the output signal, it is preferable to suppress the diffuse sound from the output signal and also to suppress portions of the direct sounds which originate from directions different from the desired direction (according to said desired output direction) in which the output signal should be enhanced.

Hence in the following, in the context of the construction of the filter coefficients, sound waves received by a perception system from directions within certain (determined/predetermined) perception beam(s) (desired output directional response) are considered as direct sounds, while sound waves from other directions are considered diffuse sounds. The term perception beam is associated with the certain desired output directional response to be obtained in the output signals.

As noted above, the perception system from which input sound signals are received may include an array of microphones which may be omni-directional microphones or may be associated with certain preferred directional responses. In some specific embodiments of the invention a perception system including two microphones serves for providing two input sound signals. The two microphones may be substantially omni-directional. Super-position of the two input signals for the generation of two sound beam signals with different directional response may be performed by gradient processing utilizing the so called delay and subtract method to form two gradient (cardioid) signals from which the amount of direct and diffuse sound is computed. Directional analysis, according to some embodiments of the invention includes obtaining and/or forming (computing) of at least two sound beam signals corresponding to two different directional responses (at least one of which is non-isotropic). Formation (computing) of a sound beam signal with regard to particular directional response (e.g. particular enhancement (suppression) direction(s)) may be obtained by super-positions of the input sound signals received from the perception system with respectively different time delays between the signals. Obtaining (receiving) sound beam signals from the perception system is generally possible when the perception system includes substantially directional microphones that inherently have certain preferred directions of sensitivity.

Hence according to a broad aspect of the present invention there is provided a system for use in filtering of an acoustic signal and for producing an output signal of attenuated amount diffuse sound. The system includes a filtration module and a filter generation module comprising a directional analysis module and filter construction module. The filter generation module is configured for receiving at least two input signals corresponding to an acoustic field.

The directional analysis module is configured and operable for applying a first processing to analyze said at least two received input signals and determining directional data including data indicative of the amount of diffuse sound in the analyzed signals. Filter construction module is configured to utilize the predetermined parameters of the desired output directional response and the required attenuation of diffuse sound in the output signal for analyzing said directional data, and generating output data indicative of operative parameters (filter coefficients) of the filtration module. In order to reduce artifacts from the output signal, the filter construction module may be also adapted for applying time smoothing to the operative parameters.

This filtration module is configured to utilizing the operative parameters for applying a second processing to at least one the input signals for producing an output acoustic signal with said desired output directional response and with amount of diffuse sound corresponding to the required attenuation of diffuse sound. In some embodiments of the invention the filtration module is configured and operable for applying spectral modification to one of the input signals utilizing said operative parameters. Filtration module may be implemented by various types of filters (e.g. gain/Wiener filters).

In accordance with some embodiments of the invention the filter generation module includes a beam forming module configured and operable for applying beam forming to input signals for obtaining at least two acoustic beam signals associated with different directional responses. In these embodiments typically the directional analysis module is configured for the first processing the acoustic beam signals for determining directional data therefrom. Acoustic beam signals may be obtained by any beam forming technique for example by utilizing superposition the input signals with delays between them (time or phase delays). In order to reduce artifacts associated with the beam forming of the signals, the beam forming module may be adapted for applying a magnitude correction filter to said acoustic beams signals.

When small number of input signals are provided delay and subtract technique may be used for beam forming. For example in some embodiments of the invention the input signals may originate from omni-directional microphones and delay and subtract technique is used for obtaining acoustic beam signals of cardioid directional responses.

According to some embodiments of the invention, the filter generation module is configured for decomposing the signals into portions (e.g. time and frequency tiles). Directional analysis may be performed for said portions for obtaining powers of direct and diffuse acoustic components corresponding to said portions and determining directions from which said direct acoustic components originate.

According to some embodiments of the invention, the system includes time to spectra conversion module configured for decomposing said analyzed signals into time and/or frequency portions, possibly by utilizing division of the signals into time frames and frequency bands by utilizing for example short time Fourier transform. Alternatively or additionally some of the input signals may be provided in the Fourier domain.

According to another broad aspect of the present invention there is provided a method for use in filtering an acoustic signal. The method utilizes data indicative of predetermined parameters of a desired output directional response and of a required attenuation of diffuse sound to be obtained in the output signal by filtering of the acoustic signal. The method includes receiving at least two different input signals corresponding to an acoustic field and applying a first processing to the input signals for obtaining directional data indicative of amount of diffuse sound in the processed signals. Then utilizing the directional data, and the data indicative of predetermined parameters of the output directional response and of the required amount of diffuse sound, for generating operative parameters for filtering one of the input signals.

According to some embodiments of the invention, a second processing utilizing the operative parameters is applied to one of the input signals for filtering the signal and producing an output acoustic signal of said output directional response and the required attenuation of diffuse sound in the output signal.

In some embodiments of the present invention, the direction estimation and diffuse sound estimation methods may be performed using any known or yet to be devised in the future processing method which is suitable for providing appropriate directional information and is not necessarily limited to the gradient method.

It will also be understood that the system according to the invention may be a suitably programmed computer. Likewise, the invention contemplates a computer program being readable by a computer for executing the method of the invention. The invention further contemplates a machine-readable memory tangibly embodying a program of instructions executable by the machine for executing the method of the invention.

Thus, in accordance with some embodiments of the present invention there is provided a system, a method and an apparatus for processing signals arriving from two or more microphones. According to some embodiments of the present invention, the apparatus for processing may include an audio processing circuit for receiving two-or-more time-synchronized audio signals and for outputting a single audio signal representing the filtered sound of one of the received audio signals, wherein sounds arriving from directions different than a pre-defined spatial direction are attenuated.

BRIEF DESCRIPTION OF THE DRAWINGS

In order to understand the invention and to see how it may be carried out in practice, embodiments will now be described, by way of non-limiting examples only, with reference to the accompanying drawings, in which.

Figure 1A:
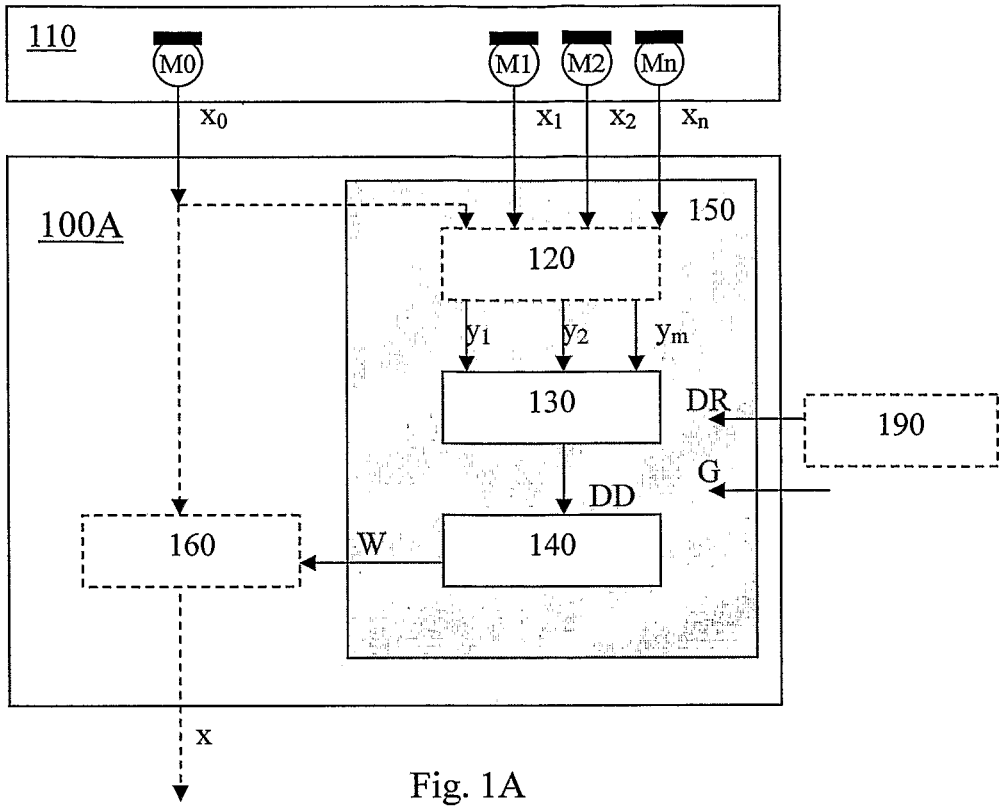
FIG. 1A is a schematic illustration of a directional acoustic (sound) filtration system according to the present invention in the general time-domain.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE EMBODIMENTS

In the following detailed description, numerous specific details are set forth in order to provide a thorough understanding of the invention. However, it will be understood by those skilled in the art that the present invention may be practiced without these specific details. In other instances, well-known methods, procedures, components and circuits have not been described in detail so as not to obscure the present invention.

Some embodiments of the present invention relate to a system, a method and a circuit for processing a plurality of input audio signals (audio channels) arriving from respective microphones, possibly after amplification and/or after analog to digital conversion and time synchronizations of the signals. Possibly also, an extra microphone calibration might be applied by a microphone calibration module. The use of such a calibration module is optional; the calibration module is not part of this invention and is only mentioned for clarification. Proper microphone calibration is referred to as a part of the microphone signal at the input to this invention's processing, and the module can be any kind of filter which is intended for improving the match between the two microphones. This filter may be fixed in advance or adapted according to the received signal. Thus, in the enclosed embodiments and the drawings, a reference to the microphone signals may relate to signals after calibration filtering.

Reference is made to FIG. 1A exemplifying the general principles of operation of an acoustic (sound) filtering system 100A according to the present invention. System 100A includes a filter generation module 150 which is associated with a perception system 110 and also is associated with a certain filtration module 160 and is configured and operable for determining operative parameters for the filtration module. The latter may or may not be a constructional part of system 100A and is responsive to the output of filter generation module 150.

It should be understood that the modules of the systems according to the invention may optionally be implemented by electronic circuits and or by software or hardware module or by combination of both. In this respect, although not specifically shown in the figures, the modules of the present invention are associated with one or more processors (e.g. Digital Signal Processor) and with storage unit(s) which are operable for implementing the method of the invention. Also the filter generation module 150 and the filtration module 160 are associated with one or more acoustic ports for receiving therefrom input signals to be processed by the system and/or for outputting therethrough filtered signals Filter generation module 150 is configured and operable for receiving, from perception system 110, at least two input signals (in this example n input signals $x_1, x_2 \ldots x_n$) which are associated with an acoustic field (e.g. sound field) and processing and analyzing these input signals to determine the operative parameters for the filtration module to enable further processing to be applied to one of said input signals by the filtration module operating with the operative parameters. Filter generation module 150 applies the processing to n input signals and obtains directional data including data indicative of diffuseness of the signals. The so-obtained data is then analyzed by the filter generation module 150 utilizing certain theoretical data indicative of predetermined parameters of a desired output directional response and required amount of diffuseness in the output signal. This analysis provides for determining the operative parameters (filter coefficients) W suitable for use with the predetermined filter module for filtering an input signal $x_0$ corresponding to the sound field. The filtration module 160 is configured and operable for applying directional filtration to the input signal $x_0$ which, when applied with the optimal operative parameters (filter coefficients), allows to obtain an output signal x with reduced noise (reduced background noise).

Preferably, said predetermined filtration module 160 is configured and operable for applying adaptive filtration to the input signal $x_0$ in any of the time and/or the spectral domains. Accordingly, the optimal filter coefficients W are determined dynamically, for each time-frame/spectral-band to allow adaptive filtration of the input signal $x_0$ by the filtration module 160. The filter generation module 150 includes a directional analysis module 130, a filter construction module 140 and possibly also a beam forming module 120. Directional analysis module 130 is configured for utilizing sound beam signals of different directional responses for determining directional characteristics of the sound field while a filter construction module 140 utilizes said directional characteristics to determine operative parameters of a predetermined filter module (e.g. adaptive spectral modification filter).

In some embodiments of the present invention the input signals, $x_1$-$x_n$, corresponds different directional responses. In this case, at least some of said sound beam signals $y_1$-$y_m$ may be constituted by some of the input and thus the use of beam forming module 120 may be obviated. Alternatively or additionally, beam forming module 120 is used for generating the sound beam signals $y_1$-$y_m$. Beam forming module 120 is adapted for receiving the plurality of input signals $x_1$-$x_n$ and forming therefrom at least two sound beam signals (in this example a plurality of m sound beam signals $y_1$ to $y_m$), each having a different directional response. It should be noted that beam forming may be performed in accordance with any beam forming techniques suitable for use with the input signals provided. Preferably, when a small number of input signals is used, a magnitude correction filter is applied to the acoustic beams signals for reducing low frequency artifacts from the sound beam signals.

Directional analysis module 130 receives and analyzes the plurality of sound beam signals $y_1$-$y_m$ and provides data indicative of estimated directions of propagation of sounds (e.g. sound waves) within the sound field and of directional (parametric) data DD characterizing the sound field. Such directional data DD generally corresponds to the direction of sounds within the sound field and possibly also to amount/power of diffuse/ambient sound components and direct sound components and the directions from which direct sound components originate. The directional data/parameters DD are generated by the directional analysis module 130 and input to the filter construction module 140. Filter construction module 140 utilizes the directionality data DD for determining the operative parameters (coefficients) W suitable for use in the predetermined filtration module (160) for implementing a directional filter which is to be applied to an input signal $x_0$ corresponding to the acoustic filed. This may be one of the n input signals. The coefficients W are typically determined by the filter construction module 140 based on given criteria regarding a desired output directional response DR and required amount of diffuseness G to be obtained in the filtered output signal.

Filtering module 160, for which the operative parameters W are determined, is configured for filtering an input acoustic signal $x_0$ by applying thereto a certain filtering function to obtain an output signal of an attenuated noise. The filtering function, when based on the operative parameters W, enables to obtain the output signal with the output directional response similar to the desired output directional response DR and with the required amount of diffuseness G. Noise attenuation is thus achieved by suppression/attenuation of diffuse sounds and of sounds originating from directions outside a perception beam of the desired output directional response. The degree of noise attenuation is also dependent on the required amount of diffuseness G in the output signal $x_0$.

It should be noted that the term output directional response may correspond to any directional response function that is desired in the output signal. Parameters defining such directional response may include for example one or more direction(s) and width(s) of the directional beams from which sounds should be enhanced or suppressed. The amount/gain of diffuse sound components (diffuseness) G in the output acoustic signal x may be of a dB value relative to the amount of diffuse sound in the input (microphone) signals, representing the desired ambience of the output signal.

It should be understood that in the conventional approach for noise filtration, only the contents of the audio channel (signal) to be filtered is used for estimating the noise that should be suppressed from the channel. According to the present invention, noise estimation is based on additional data (multiple channels/input signals), indicative of the acoustic/sound field. This provides more accurate noise estimation and superior results.

Thus, the present invention takes advantage of beam forming techniques for combining multiple channels and for performing directional analysis of the sound field. After directional analysis of the sound field is obtained, operative parameters (filter coefficients) are determined. This enables application of operative parameters for filtering a single audio channel (input signal), thus eliminating artifacts of the beam forming.

Noise estimation and filter construction are based, according to the invention, on directional analysis of the sound field. This may be achieved by receiving substantially omni-directional input sound signals (e.g. x1 and xn) (e.g. from substantially omni directional microphones M1-$M_n$ of the sound perception system 110) and utilizing beam forming (e.g. utilizing beam forming module 120) for providing the sound beam signals (e.g. y1 and ym) having certain preferred directional responses (i.e. with enhanced sensitivity to certain directions). Beam forming module 120 is however optional and can be omitted in case the perception system 110 itself provides the input signals (e.g. y1 and y2) of different directional responses (e.g. at least one of which originates from non omni-directional microphone or has non isotropic directional response). In this case, the input signals from the perception system might have by themselves enhanced (or suppressed) directional response with regard to certain directions and thus may serve as sound beam signals for the directional analysis module 130.

Directional estimation for determination of a direction of a sound wave can be generally performed by comparing the intensities/powers of corresponding portions of two or more sound beams (beam formed signals generated from the input signals) which have different directional responses. Considering for example, two sound beams of two different non isotropic directional responses (e.g. having different principal directions of enhancement/suppression of sounds), a planar sound wave would typically be perceived with greater intensity by the sound beam having greater projection of its principal direction on the direction of the wave's propagation. Hence, by comparing the intensities of the signal portions corresponding to the same sound wave in two or more sound beams, and by utilizing knowledge regarding the directional responses of the sound beams, the direction, $\phi$, of the signal origination (from which the sound wave propagates) can be estimated/analyzed.

Moreover, the intensity of direct sound component $P^{DIR}$ (i.e. propagating from that direction) and diffuse sound component $P^{DIFF}$ in the signal portions can be estimated based for example on the correlation between the signal portions of the two sound beams. In this respect the high correlation value between signal portions of different sound beams is generally associated with high intensity of direct sound $P^{DIR}$, while relatively low correlation value typically corresponds to high intensity of diffuse sounds $P^{DIFF}$ within the signal portions.

It should be noted that a direction of sound origination as well as the amount of direct and diffuse sounds can be estimated for each portion (e.g. time frame and frequency band) of the sound beam signals (and correspondingly to each portion of the input sound signals, e.g. portions of the sound signal to be filtered). Accordingly, the term portion of the sound signal is used to designate a certain data piece of a sound signal. Referring to digital signals, the signals may be represented in the time domain (intensity as a function of discrete sample index/time-frame), in the spectral domain (intensity & optionally phase as function of the frequency band (frequency bin index)), or in a combined domain in which intensity and optionally phase are presented as functions of both the time frame index and the frequency band index. Hence, in the following and when no other meaning is suggested, the term portion of a signal designates a data piece associated with either one of a particular time-frame index(s) or frequency-band index(s) or with both indices.

As noted above, reduction of the amount of noise in the output signal is achieved according to the invention by the construction of a directional filter (filter coefficient) which is applied to the signal to be filtered to generate therefrom an output signal of a desired directional response DR. For example, this is aimed at enhancing sounds, such as speech, originating from particular one or more directions (included in the directional response data DR) in which sound source(s) to be enhanced are assumed, while suppressing sounds from other directions. The directional response data DR can be provided to the filter construction module 140 or can be constituted by certain fixed given directions (with respect to the perception system 110) with respect to which sounds should be enhanced. In accordance with those directions DR, the operational parameters of the filtration module 160 are determined by the filter computation module 140 based on the above described directional analysis of the directions from which different sound waves (and accordingly different portions of the sound signal to be filtered), originate.

A sound signal to be filtered $x_0$ (and each portion thereof) is considered to include a signal component $x_0^{DIR}$ designating the intensity of sounds from the particular directions DR (direct sound) and noise sound component $x_0^{DIFF}$ (often considered as undesired or noise signal) designating the intensity of sounds outside the particular directions of non-directive sound (denoted diffuse sound) with respect to said directions DR (e.g. $x_0=x_0^{DIR}+x_0^{DIFF}$). In this respect, the intensities, $P^{DIR}$ and $P^{DIFF}$, of direct and diffuse sound components and the direction of arrival $\phi$ of the direct sound which are estimated utilizing directional analysis of the sound field may serve for estimations of the intensities or powers of signal component $x_0^{DIR}$ and diffuse sound component $x_0^{DIFF}$ in the signal to be filtered. It should be noted that $x_0^{DIFF}$ and $P^{DIFF}$ refer to diffuse sound signal and power, respectively, which can be considered as noise, but does not necessarily relate to noise in the traditional sense. In practice, also signals which are independent between the input signal channels may be identified as diffuse sound.

According to the above, a directional filter can be obtained based on the directional data DD (e.g. $P^{DIR}$, $P^{DIFF}$ and $\phi$) the estimated direction from which each portion of the sound signal originates. Various types of filtering schemes can be adapted for the creation of such a directional filter. For example, a filter scheme assuming a very narrow directional beam might be obtained by attenuating the sound intensity of each portion of the signal to be filtered which does not originate from the exact direction(s) DR. By utilizing the direction estimation described above, the amount of direct and diffuse sound components in each portion of the signal to be filtered are estimated with regard to the particular directions DR and to certain width of these directions.

It should be noted that according to some embodiments of the invention, the direction(s) DR from which sounds should be enhanced (directions of sound sources of interest) are fixed with respect to the perception system 110 (e.g. enhancing sounds originating in front of the perception system 110). Alternatively, these direction(s) DR are given as input to the filter generation module 150. These directions DR may be inputted by the user or may be obtained by processing for example based on the detection of particular sound sources within the sound field. In the present example, sound source detection module 190 is used in association with the system 100 for detection of the direction(s) DR in which there is/are sound source(s) that should be enhanced by the system 100. This can be achieved for example by utilizing voice activity detector, VAD.

Figure 1B:
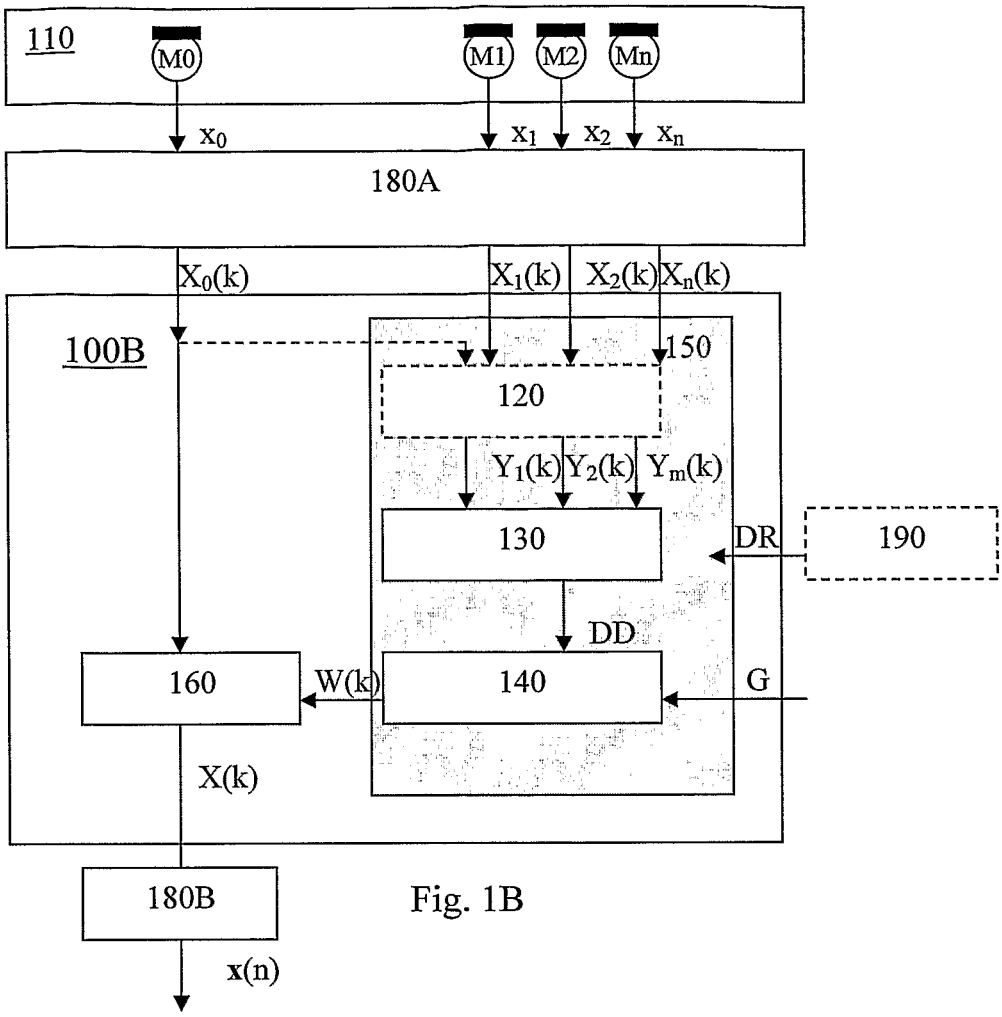
FIG. 1B is a schematic illustration of a directional sound filtration system according to the present invention adapted for operating in multiple frequency bands.

In the examples of FIGS. 1A and 1B, the signal x0 that is eventually filtered is optionally provided also as an input signal for the filter generation module 150. Typically in cases where sound perception system of a small number of microphones is used, the signal to be filtered is indeed provided to the filter generation module 150. This is however not necessary, and in many cases the actual input signal to be filtered is not one used for directional analysis. For example microphones of one kind are used for directional analysis and filter generation, and a microphone of a different kind is used for perception of the audio signal that should be filtered.

In the example of FIG. 1A, the sound signals (x1 to xn) and the following processing of the signals are described generally without designating the domain (time/frequency) in which the signals are provided and in which the processing is performed. It should be noted however that the system may be configured for operating/processing of signals in the time domain, in the spectral/frequency domain or signals representing short time spectral analysis of the sound field.

Figure 2A:
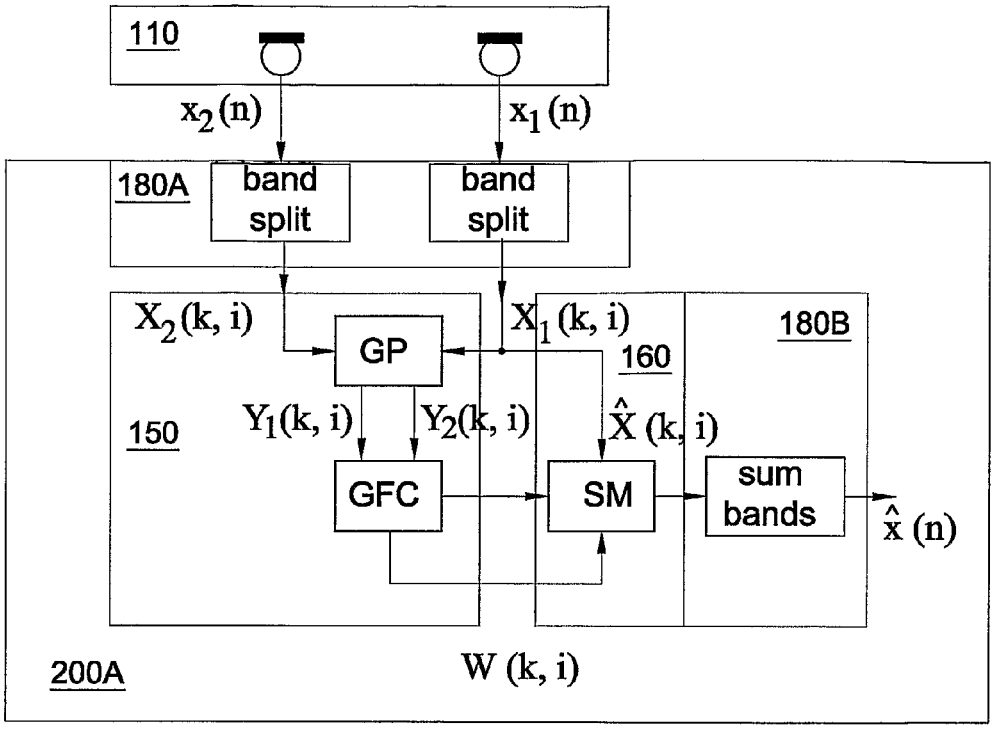
FIG. 2A is a schematic illustration of a directional sound filtration system configured for implementing a directional filter based on input signals from two microphones.
Figure 2B:
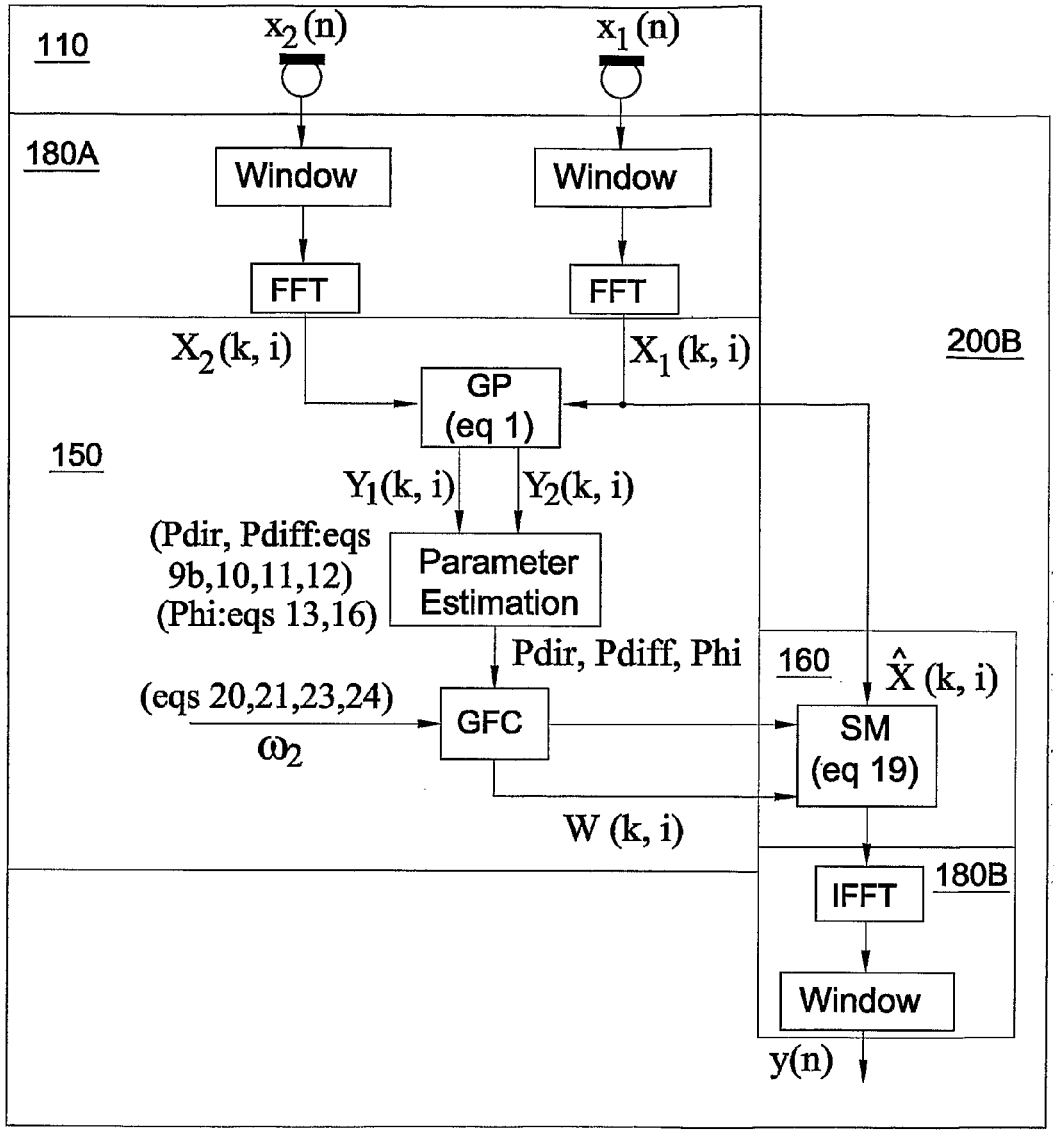
FIG. 2B is a more detailed illustration of the system of FIG. 2A in which band-split of the input signals into multiple bands is obtained utilizing short-time Fourier transform.

Some embodiments of the proposed algorithm are advantageous to be carried out in frequency bands, wherein the microphone signals are converted to a sub band representation using a transform or a filterbank, as illustrated by way of example in FIG. 1B. To perform the frequency separation into multiple bands, a non-limiting example is given wherein the separation uses a discrete Fourier transform, as is shown in FIG. 2B. A discrete time signal is denoted with lower case letters with a sample index n, e.g. x(n). The discrete short-time Fourier transform (STFT) of a signal x(n) is denoted X(k, i), where k is the spectrum time index and i is the frequency index.

Turning now to FIG. 1B there is illustrated a system 100B according to the present invention in which the sound signals are processed in the spectral domain. Common elements in all the embodiments of the present invention are designated in the corresponding figures with the same reference numerals.

In this example, the signals x(n) in the time/sample domains are divided by band splitting module 180A into time-frames and spectral bands tiles/portions X(k, i) each designating the intensity (and possibly phase) of sound in a particular frequency band at a particular time frame. As noted above, this division of the input signals may be obtained by applying STFT on the input signals x(n). For example, this may be achieved by first dividing the input signals into time frames and then applying Discrete Fourier transform to each time frame. Generally, the duration of each time frame (the number of sound sample in each time frame) is selected to be short enough such that the spectral composition of the signal (x(n)) can be assumed stationary along the time direction while also being long enough to include a sufficient number of samples of the signal x. Speech signals for example can be assumed stationary over short-time frames e.g. between 10 and 40 ms. Considering sound sampling rate of 20 kHz and sound stationary duration of 20 ms, each time frame k includes 400 samples of the input signal to which DFT (discrete Fourier transform) is applied to obtain X(k, i). Similarly as described above, the signal tiles $X(k, i)=X^{DIR}(k, i)+X(k, i)^{DIFF}$ in the time-frequency domain are assumed to include direct $X^{DIR}(k, i)$ (signal to be enhanced) and diffuse $X(k, i)^{DIFF}$ (noise) sound components. Estimation of the noise content $X'_0(k, i)^{DIFF}$ in the signal tiles is achieved as described above, based on directional analysis of the at least two of the input signals $X_0(k, i)$ to $X_n(k, i)$ utilizing the directional filter generation module 150 of the invention. The amount of diffuse sound $X(k, i)^{DIFF}$ in each spectral band i of a time frame k is estimated based on the directional analysis of the sound field (utilizing multiple input signals from which parametric characterization of the sound field is obtained). Accordingly, the filter G is constructed such as to modify the respective spectral band in the output signal e.g. to reduce the amount of diffuse sound (which is associated with noise) in the output signal $X'_0$.

A gain filter W is constructed according to the estimated noise X'hd 0$(k, i)^{DIFF}$. The gain filter is applied to one of the signal to be filtered $X_0$ by filtration module 160 and an output signal of the form $X'_0 \sim X_0^{DIR}+(X_0^{DIFF}-X'^{DIFF}_0)$ is obtained. Filtration module 160 actually performs spectral modification (SM) on the time-spectral tile portions $X_0(k, i)$ of the input signal $x_0$. The inverse of the short-time Fourier transform (STFT) is thereafter performed by spectra-to-time conversion module applied 180B and substantially noiseless sound signal $x_0'(n)$ is obtained.

It should be noted that the output signal $X'_0$ (in the time-frequency domain) differs from the desirable noiseless signal $X_0$ by a difference between the spectral content of the actual noise $X_0^{DIFF}$ and the estimated spectral content of the noise—$X'^{DIFF}_0$. Hence, providing accurate noise estimation is highly desirable for implementing noise suppression technique with high signal to noise output. Generally, the noise estimation may be an adaptive process performed per each one or multiple time frames in accordance with the noise estimation scheme (filtration scheme) used. Also, since human perception is relatively insensitive to phase corruption, the estimated phases of the noise $X'^{DIFF}_0$ can be evaluated roughly in accordance with the noise estimated technique used. Accordingly, it may be sufficient to utilize only the magnitude (intensity) (and not the phase) of the STFT input signals, $|X(k, i)|$, for the estimation of the noise $X'^{DIFF}_0$ in order to recover the desired sound signal. This, in turn, simplifies and reduces the processing required with the noise estimation and directional analysis in the technique of the present invention while not hampering the signal to noise SNT (or at least the audible SNR) in the output signal.

As noted above, one of the prominent advantages of the technique of the present invention is that it enables utilizing a small number (down to two) of sound receptors/microphones for providing directional filtering of sound signals without the artifacts generated when beam forming is used for the generation of an output signal based on such a small number of microphones. In the following description, the processing, in digital domain, of two microphone signals, is discussed. However, as is also noted above, some embodiments of the invention are not limited in this respect, and the present invention may be implemented with respect to more than two microphones and more than two microphone signals/audio channels. Also, it should be noted that the invention can be implemented (e.g. by analogue electronic circuit) for processing analogue signals. In the digital domain, however, the modules of the system of the present invention can be implemented as the electronic circuit (hardware), or software module or by combination of both. FIG. 2A provides an illustration of the directional processing of two microphone signals for the multi-band case and system 200A implementing the same according to an embodiment of the present invention. The two microphone signals are possibly amplified and converted to digital domain, and are time-synchronized before they are processed by system 200A to obtain a single filtered output audio signal.

The processing modules of system 200A include: preliminary and posteriori processing modules namely time-to-spectra conversion module 180A and spectra-to-time conversion modules 180B performing respectively preliminary frequency band-split of the two (or more) input microphone signals; and posteriori frequency-band summation processing for obtaining the output signal in the time domain. The main processing of the sound filter is performed by a filter generation module 150 which receives and utilizes the signals from the at least two microphones (after being band split) for generating a directional filter; and filtration module 160 configured for spectral modification (SM) of at least one of the input signals based on the thus generated filter. Filter generation module 150 includes three sub modules including a beam forming module 120 configured, in this example, for performing gradient processing (GP) of the input signals for generating therefrom sound beam (cardioid) signals, directional parameters estimation module 130, and gain filter computations (GFC) module 140.

Similarly to the embodiment of FIG. 1B, also here the filter generation (carried out by filter generation module 150) and the filtering of an input signal (carried out by filtration module 160) are performed utilizing representations X1 and X2 of the input sound signals in the spectral domain (e.g. time-spectra tiles obtained by STFT). Accordingly, band splitting module 180A (time to spectra conversion module) is used to split the input signals into multiple portions corresponding to different spectral bands. This enables the filter generation and filtration of an input signal according to the invention to be carried out independently for each spectral band portion. Eventually, the different spectral band portions (after filtration) of the input signal to be filtered are summed by spectral to time conversion module 180B.

It should be noted that the time-to-spectra and spectra-to-time conversion modules 180A and 180B are not necessarily a part of the system 200 and the band splitting and summation operations may be performed by modules external to the sound filtration system (200) of the invention. Also, the outputs of the time-to-spectra conversion (band split) module 180A are multi-band signals, so the gradient processing (GP) module in this case is repeatedly applied to each of the bands.

FIG. 2B provides a more detailed illustration of the processing in case the multi-band processing is done using short-time discrete Fourier transform (STFT). System 200B of this figure includes similar modules as those of system 200A above.

Both sound filtering systems 200A and 200B of FIGS. 2A and 2B implement a directional filter module which receives and processes two microphone signals as input, and a filtration module based on these signals which is applied to one of the signals to obtain a single filtered audio signal as output. The systems 200A and 200B can be implemented as an electronic circuit and/or as a computer system in which the different modules are implemented by software modules, by hardware elements or by a combination thereof.

Here, the spectra-to-time module 180A is configured for carrying out a short-time Fourier transform (STFT) on the input signals, and the time-to-spectra module 180B implements inverse STFT (ISTFT) for obtaining the output signal in the time domain. In this example, two time-domain microphone signals are short-time discrete-Fourier-transformed, using a fixed time-domain step (hop size) between each FFT frame, so that a fixed frame overlap is generated. A sine analysis STFT window and the same sine synthesis STFT window may be used. In some embodiments, time variable frame size and window hop size may possibly also be used. After the directional filter is generated and applied to the spectral bands of one of the input signals as described in detail below, the result of the filtering is inverse-Fourier-transformed and the transformation windows are overlapped to generate the output signal. It should also be noted that in this example the outputs of the FFT modules are in the complex frequency-domain, so that the beam forming (gradient processing (GP) is applied as complex operation on the frequency-domain bins. In this example, directional filter generation module 150 and filtration module 160 receive two microphone signals (x1 and x2). The signals are provided in this example in digital form and are time-synchronized. The signals x1 and x2 are converted by STFT to the spectral domain X1 and X2 and are processed by the directional filter generation module 150 to obtain a filter (operational parameters for the filtration module) which is then applied to one of the input signals (in this example to X1) in accordance with the above described spectral modulation filtering such that a single filtered audio signal is provided as output.

Figure 2C:
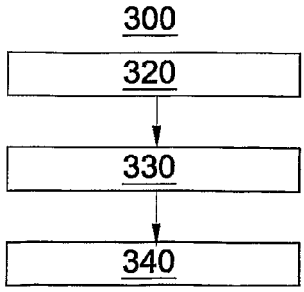
FIG. 2C is an example of a directional sound filtration method according to the invention.

As noted above, the filter generation module 150 includes three sub-modules: beam forming module 120, directional analysis module 130 and filter computation module 140. The operation of these modules will now be exemplified in detail with reference made together to FIGS. 2B and 2C. FIG. 2C illustrates the main steps of the filter generation method 300 according to some embodiments of the present invention which is suitable for use with system 200B of FIG. 2B.

In the first step 320 (which is implemented by beam forming module 120 of FIG. 2A), beam forming is applied to the two input sound signals X1 and X2 for generating therefrom two sound beam signals Y1 and Y2 with certain non-isotropic directional response (at least one of the directional responses is non-isotropic). In general, beam forming can be implemented according to any suitable beam forming technique for generating at least two sound beam signals each having different directional response. In the present example, beam forming of the input audio signals X1 and X2 is performed utilizing the delay and subtract technique to obtain two sound beam signals Y1 and Y2 of the so-called cardioid directional response. Accordingly, in the following, the two sound beam signals Y1 and Y2 are also referred to interchangeably as cardioid signals or sound beam signals. In this example, the beam forming module 120 includes a gradient processing unit GP which is adapted for implementing delay and subtracting the two input signals X1 and X2 (represented in the spectral domain), and for outputting two sound beam signals Y1 and Y2.

Gradient-processing (GP) includes delaying and subtracting the microphone signals, wherein both delay and subtraction can be referred to in the broad sense. For example, delay may be introduced in the time domain or in the frequency domain, and may also be introduced using an all-pass filter, and for subtraction a weighted difference may be used. As a non-limiting example, in the following description of some of the embodiments of the present invention, a complex multiplication in the frequency domain is used to implement the delay. Since in case the microphones are omni-directional, the gradient signal after GP above can be referred to as a virtual cardioid microphone; the gradient processed-signals are referred to herein as "cardioids", only for simplicity of explanation.

In this example, gradient processing (GP) is applied to the input signals to obtain two cardioid signals pointing in opposite directions, when subsequent directional analysis is performed based on the cardioids STFT spectra.

In the following description, it is shown how the cardioid signals are computed as a function of microphone spacing. The distance between the two omni microphones is assumed to be $d_m$ meters. The two cardioid signals pointing towards microphones 1 and 2 are obtained by implementing the delay and subtract operation in the frequency domain (note that this operation can also be implemented in the time domain by a person of ordinary skill in the art):

$$Y_1(k,i)=X_1(k,i)-\exp(-j*(I*Tao*Fs)/N_{FFT})*X_2(k,i)$$

$$Y_2(k,i)=X_2(k,i)-\exp(-j*(I*Tao*Fs)/N_{FFT})*X_1(k,i)$$

where $N_{FFT}$ is the FFT size, and Tao is the time that sound needs to travel from one microphone to the other, given by Tao=dm/Vs where $V_s$ is the speed of sound in air, i.e. 340 m/s.

Figure 2D:
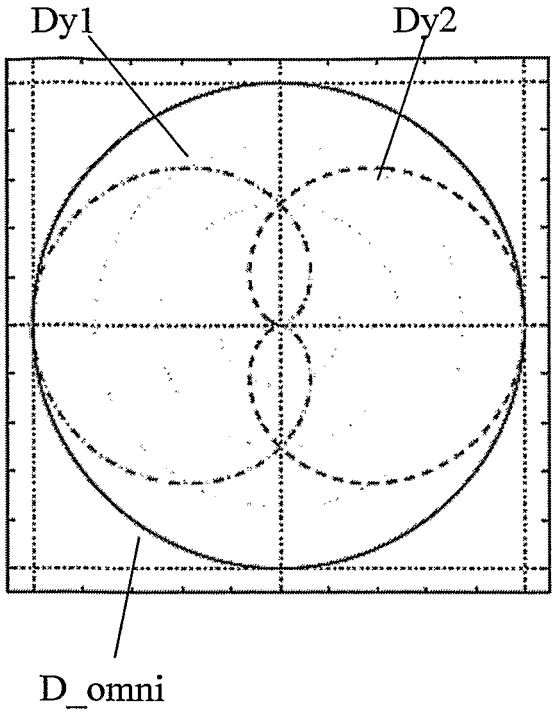
FIG. 2D is schematic illustration of the directional responses of two sound beam signals obtained by gradient processing of input signals from two microphones.

Considering the input signals $X_1$ and $X_2$ originate from two omni directional microphones, the directional responses of the two cardioid signals $Y_1$ and $Y_2$ illustrated in FIG. 2D are respectively (ϕ being an angle of sound arrival):

$$Dy1(\phi)=0.5+0.5\cos(\phi)$$

$$Dy2(\phi)=0.5-0.5\cos(\phi)$$

Note that these responses depend on the specific delay and subtract processing that was applied for generating the cardioid signals. In this example the two cardioid signals are obtained from processing input signals from two omni directional microphones having omni directional response D_omni as illustrated in the figure.

Preferably, in order to prevent large values at low frequencies, a magnitude compensation filter H(i) is applied to the two cardioid signals as follows:

$$Y_1(k,i)=H(i)*(X_1(k,i)-\exp(-j*(I*Tao*Fs)/N_{FFT})*X_2(k,i))$$

$$Y_2(k,i)=H(i)*(X_2(k,i)-\exp(-j*(I*Tao*Fs)/N_{FFT})*X_1(k,i))$$

An example of a magnitude compensation filter is given by H(i)=min(Hmax, 0.5/sin(Tao*wi)), where $w_i=2*Pi*I*f_s/N_{FFT}$ and $H_{max}$ is an upper limit for this filter. Other magnitude compensation filters may be used, depending on the desired frequency response of the cardioid signals.

It should be noted that according to some embodiments, the delay and subtract operation is first performed in the time domain, on the sampled input signal from the first and second microphones x1(*n*) and x2(*n*) (in the time domain). According to these embodiments the signals from the microphones x1(*n*) and x2(*n*) are first fed into the beam forming module 120 (e.g. gradient processing unit (GP)) to obtain sound beam signals y1(*n*) and y2(*n*) and then the sound beam signals in the time domain are converted into the spectral domain by band splitting module 180A (e.g. by STFT).

In the second step 330 (which is implemented by directional analysis module 130 of FIG. 2A), the gradient processing unit (GP) provides gradient signals Y1 and Y2 as output. The gradient signals Y1 and Y2 at time instance n are fed to a directional analysis module 130 to compute direction estimation, direct sound estimation, and diffuse sound estimation. The proposed directional analysis algorithm carried out in this step is adapted to differentiate directive sound from different directions and to further differentiate directive sound from diffuse sound. This is achieved by utilizing the two cardioid signals obtained by delay-and-subtract processing in the previous step.

Directional analysis of the sound field is generally obtained by assuming that the two sound beam (cardioid) signals Y1(*k, i*) and Y2(*k, i*) are associated with the same sound field. In this example, the cardioid signals Y1(*k, i*) and Y2(*k, i*) can be modeled similarly to signal models used for stereo signal analysis (as described in reference [2]) as:

$$Y_1(k,i)=S(k,i)+N_1(k,i)$$

$$Y_2(k,i)=a(k,i)S(k,i)+N_2(k,i)$$

where a(k, i) is a gain factor arising from the different directional responses of the two signals, S(k, i) is direct sound, and $N_1$(k, i) and $N_2$(k, i) represents diffuse sound.

Note that in the following, for simplicity of notation, the time and frequency indices k and I are often ignored. In the following description, directional parametric data DD corresponding to the power of diffuse sounds $P^{DIFF}$(k, i), power of direct sound $P^{DIR}$(k, i), and direction of arrival (e.g. which is indicated by the gain factor a(k, i)) of direct sound are derived/estimated for each of the time-frame—spectral band tiles of the input signal to be filtered. These are then later used for deriving the filter which is applied to generate the output signal.

In this embodiment of the invention, directional analysis of the sound field is based on statistical analysis of the sound beam. The power $P^{DIFF}$ of diffuse sounds in the tiles of the sound beam signals Y generally equals to $P^{DIFF}(k,i)=E\{|N(k,i)|^2\}$ and the power of direct sound $P^{DIR}(k,i)=E\{|S(k,i)|^2\}$, where E{.} stands for a short-time averaging operation of the signal tiles (e.g. over one or more time frames, or by iterative "single-pole averaging") and $|S|^2=S\cdot S^*$ where * indicates complex conjugate. Accordingly derivation of the above parameters ($P^{DIFF}$, $P^{DIR}$ and direction of arrival) may be obtained statistically for each time-frame and frequency band (k, i) by considering the following assumptions:

The power of diffuse sounds in both cardioids signals are equal, i.e. $E\{N_1*N_1^*\}=E\{N_2*N_2^*\}=E\{|N|^2\}$ The normalized cross-correlation coefficient between diffuse sounds in the two cardioid signals $N_1$ and $N_2$ is certain constant value $\Phi_{diff}$($\Phi_{diff}$=⅓ works well in this embodiment of the invention).

The direct and diffuse sounds are orthogonal signals and thus their average is zero $E\{S^*\cdot N1^*\}=E\{S^*\cdot N2^*\}=0$.

Accordingly, the direct and diffuse sound components can be extracted by utilizing statistical computation of the pair correlations $E\{|Y1|^2\}$, $E\{|Y2|^2\}$, $E\{Y1\cdot Y2\}$ of the sound beam (cardioid) signals $Y_1$(k, i) and $Y_2$(k, i) as follows:

$$E\{|Y_1|^2\}=E\{|S|^2\}+E\{|N|^2\}$$

$$E\{|Y_2|^2\}=a^2*E\{|S|^2\}+E\{|N|^2\}$$

$$E\{Y_1Y_2^*\}=aE\{|S|^2\}+\Phi_{diff}*E\{|N|^2\}$$

Hence in this example, in step 330, correlations between the two sound beam signals are computed (e.g. by short time averaging of the signal pairs $E\{|Y1|^2\}$, $E\{|Y2|^2\}$, $E\{Y1*Y2\}$) and the resultant correlation values are used for solving the above three equations and for determining the powers of direct sound $P^{DIR}(k,i)=E\{|S(k,i)|^2\}$, diffuse sound $P^{DIFF}(k,i)=E\{|N(k,i)|^2\}$ and direction indicative data a(k, i).

The direction of arrival ϕ(k, i) from which direct sounds (sound waves) arrive toward the perception system can be determined based on the so-obtained gain factor a (k, i) and based on the directional responses Dy1(ϕ) Dy2(ϕ) of the sound beam signals $Y_1$ and $Y_2$. Generally, a (k, i) designates the ratio between the intensities at which sound waves in the spectral band i were perceived during time frame k by the respective sound beams signals $Y_1$ and $Y_2$. Accordingly, for directive sounds arriving from direction ϕ the gain factor a is equal to the ratio of the two directional responses of $Y_1$ and $Y_2$, i.e. the direction (angle) ϕ(k, i), from which the sound waves originate, can be obtained by equating a with the ratio Dy2/Dy1:

$$a(k,i)=Dy2\phi(k,i))/Dy1\phi(k,i))$$

In this example, by substituting the above described particular directional responses Dy2 and Dy1 of the two cardioid sound beams:

$$a=(1-\cos(\phi)/(1+\cos(\phi))\rightarrow\phi(k,i)=\cos^{-1}((1-a(k,i))/(1+a(k,i)))$$

In the third step 340 the directional data DD (ϕ, $P^{DIR}$, $P^{DIFF}$ corresponding to the direction estimation, the direct sound (power) estimation, and the diffuse sound (power) estimation) are fed to filter computation module 140 (GFC) which performs filter construction based on at least some of these parameters. Actually in this example, $\phi(k, i)$, $P^{DIR}(k, i)$, $P^{DIFF}(k, i)$ constitute data pieces DD of the directional data associated respectively with portions of time frame k and frequency band i of the signals. The filter that is constructed by module 140 (GFC) is configured such that when it is applied to one of the input signals (in this example to x1(*n*)) a directionally filtered output signal is obtained with the desired directional response.

It is important to note that the output signal is generated from only one of the original microphone signals (and not from the sound beam (cardioid) signals). This prevents low signal to noise ratio (SNR) at low frequencies (which is an artifact of the beam forming of sound beam signals).

As noted above, directional filter of the input signal x1(*n*) is constructed/implemented with regard to the specific directions from which sounds of interest arrive at the perception system (and to the microphone from which signal x1 originates). Accordingly, output directional response parameters DR including the direction(s) and width(s) of the desired directional response to be obtained in the output signals are provided. In the present example directional data includes an angle $\phi_0$ parameter which indicates the direction of the output signal directional response and a width parameter V.

The input (microphone) signal $X_1$ that is to be filtered and from which the output signal is derived, is considered to include a sum of direct $X^{DIR}$ and diffuse $X^{DIFF}$ sound components with respect to the output directional response parameters DR:

$$X_1=X^{DIR}+X^{DIFF}$$

where $X^{DIR}$ and $X^{DIFF}$ are assumed to be orthogonal and their power is specified by $P^{DIR}$ and $P^{DIFF}$. It should be understood that the powers of direct and diffuse sound components $P^{DIR}$, $P^{DIFF}$ are obtained from cardioids ($Y_1$, $Y_2$) correspond to the powers of direct and diffuse sound perceived by omni directional microphone (having omni directional response). Accordingly these powers can be used for determining the direct and diffuse signal components in the signal to be filtered $X_1$.

In the following, there is described a non-limiting example for computing the filter coefficients for processing the single microphone signal as explained above. In the following example reference is made to frequency-domain processing, however it is also possible to apply similar processing in time-domain as would be appreciated by those versed in the art.

Preferably, a filter W is constructed by the filter computation module 140 such that when it is applied to the input signal $X_1$ and output signal X of the form $X=w_1X^{DIR}+w_2X^{DIFF}$ is obtained where the weights $w_1$ and $w_2$ determine the amount of direct $X^{DIR}$ and diffuse $X^{DIFF}$ sound in the desired output signal X.

The weights $w_1(k, i)$ are obtained based on the desired direction $\phi_0$ of the output signal directional response and on the directions of arrival $\phi(k, i)$ of direct sounds in the respective sound portion (k, i) sound such that the resulting signal has a desired directivity ($\phi_0$ in the present example). The weight $w_2$ determines the amount of diffuse sound in the output signal and in many cases it may be selected/chosen (e.g. by the user) in accordance with the desired width parameter V of the desired output directional response.

The filter W (also referred to herein as a Wiener filter) is used to obtain, from one of the input signals $X_1$, an output signal Xest which is an estimate of the desired output signal X, i.e. Xest=W*X1.

In this particular example the filter coefficients W(k, i) are given by $$W(k,i)=E\{X(k,i)\cdot X1(k,i)\}/E\{X^2(k,i)\}= (w_1^2(k,i)\cdot P^{DIR}(k,i)+ w_2^2(k,i)*P^{DIFF}(k,i)/(P^{DIR}(k,i)+P^{DIFF}(k,i))$$

As noted above, the weights $w_1$ and $w_2$ determine the properties of the output signals. The weight $w_1$ is controlled so as to achieve a desired directivity and in the present example the following is used:

$$w_1(k,i)=0.5*(1+\cos(\max(\min(V(\mathrm{abs}(\phi(k,i))-\phi_0),pi),-pi)))$$

Given a desired diffuse sound gain in dB, $G_{diff}$, $w_2$ may be computed as $w_2=10\hat{}(0.05*G_{diff})$.

Generally, the filter W is thus obtained and is applied for performing spectral modification on the input signal X1 to thereby obtain an output signal X of the desired directional response. However since the filter W is an adaptive filter (e.g. which is computed per each one or more time frames) musical noise may be introduced to the output signal due to variations in the directional analysis in different frames. Such variations, when in audible frequencies, affect variations in the filter coefficients and may cause audible artifacts in the output signal. Therefore, to reduce these variations and the resulting musical noise artifacts, frequency and time smoothing can be applied to the filter W.

For example improving the audio quality of an adaptive Wiener filter W applied in frequency domain (as derived above) can be achieved by smoothing the filter W, in time, in a signal dependent way as is described in the following. The rate at which the Wiener filter evolves over time depends on the time constant used for the E{.} operations used for computing the signal statistics. The relative amount D(k, i) of desired direct sound in a time-frequency tile is computed by: $D(k, i)=w_1^2*P^{DIR}/(P^{DIR}+P^{DIFF})$. Whenever d(k, i) is smaller than a specific threshold THR, the filter W is smoothed over time, using its previous value as follows:

$$W(k,i)=\mathrm{alpha}*W(k,i)+(1-\mathrm{alpha})*W(k-1,i)$$

where alpha is a smoothing filter coefficient that is computed to reduce time-domain artifacts of the filtering.

In the above, the method 300 of filter generation (carried out by filter generation module 150) for the case of two omni-directional input signals was described in detail with respect to the particular embodiment system 200B. It should be noted that here filter coefficients are computed (separately) for each time frame and frequency (spectral) band tiles of the input signals.

According to the technique of the present invention, the filter W is applied by filtration module 160 to the short-time spectra of one of the original microphone input signals (X1). The resulting spectra are converted to the time-domain, giving rise to the proposed scheme output signal. By applying those filter coefficients W(I, K) to the time-frame and spectral-band tiles, one input filtration module 160 spectral modification to the input signal is performed.

Obtaining output signals of desired directional response by applying a filter to only one of the input microphone signals has several advantages (especially when only a small number of microphone/input-signals are used) over the use of beam forming techniques for obtaining output of similar directional response:

The derived cardioid signals obtained by beam forming (e.g. delay and subtract) of said input signals, have relatively low SNR at low frequencies, thus it is preferable not to directly use those cardioid signals to generate the output signal waveform.

Combining both input microphone signals for generating the output signal may result in comb filter and coloration artifacts and thus with inferior results.

It should be noted here that the filter generation technique according to the embodiments of FIGS. 2B and 2C has been illustrated using a complex short-time spectral domain (STFT); in further embodiments, non-complex time-frequency transforms or filterbanks may be used. In case non-complex time-frequency transforms or filterbanks are used, the statistical values as in the following description may be estimated with operations similar in spirit as was shown for the STFT example. For example E{X1X1ˆ*} is simply replaced by E{X1ˆ2}, because for the real filterbank output signals there is no need to do complex conjugate in order to obtain the magnitude square. Similarly, as opposed to using E{X1X2ˆ*}, E{X1X2} can be used.

Figure 3:
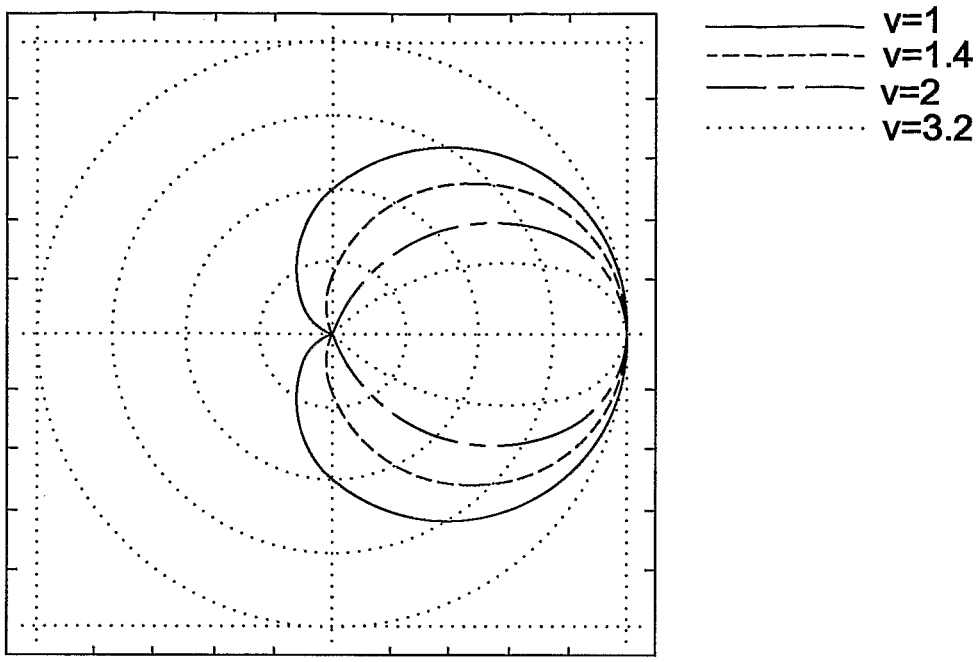
FIG. 3 illustrates directional responses of the output signal for direction $\phi_0=0°$ and different values of V.

Turning now to FIG. 3 there is illustrated an example of output directional responses for an end-fire array configuration (e.g. beam direction is substantially parallel to the line connecting the microphone positions) obtained by system 200B described above with reference to FIGS. 2B and 2C. These output directional responses are obtained in the output signal example utilizing the directional response parameters DR such that $\phi_0=0$ and various values of the beam width parameter v.

Figure 4:
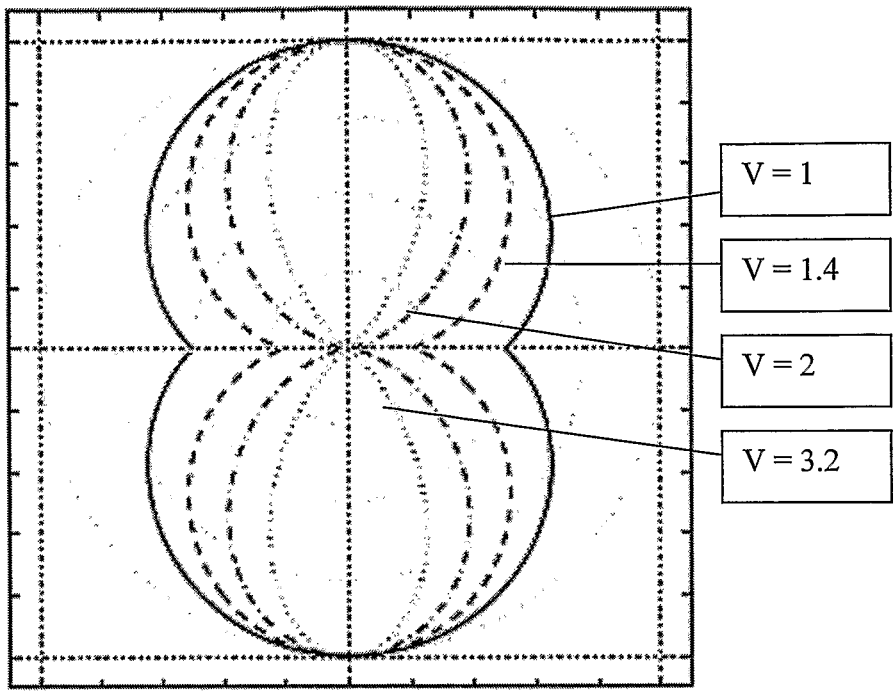
FIG. 4 illustrates directional responses of the output signal for direction $\phi_0=90°$ with different values of widths V.
Figure 5:
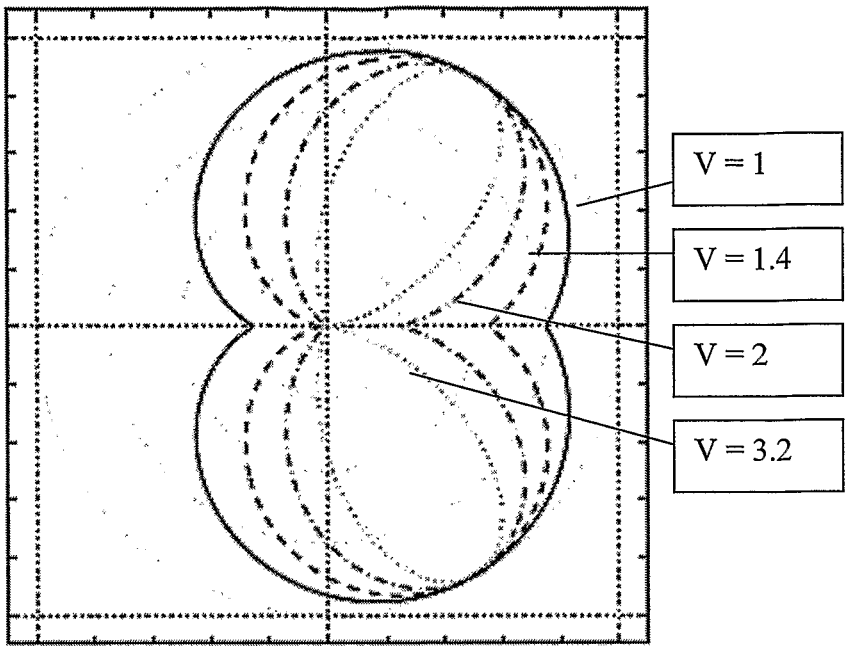
FIG. 5 illustrates directional responses of the output signal for direction $\phi_0=60°$ degrees and different values of widths V.
Figure 6:
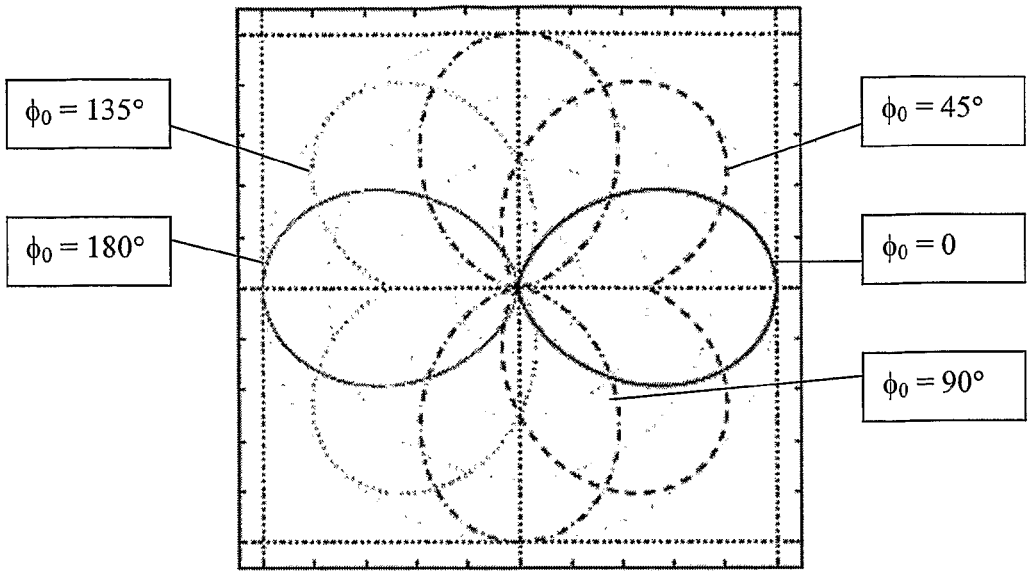
FIG. 6 illustrates directional responses of the output signal with width V=2 and for different directions $\phi_0$.

Additional examples of different output directional responses of an output signal from a directional sound filtration system of the invention are illustrated in FIGS. 4 to 6. In FIG. 4 output directional responses for a line array configuration (obtained by setting $\phi_0=90°$) are shown. Corresponding beams, but steered 60 degrees to the side, are shown in FIG. 5. Beams with width parameter V=2 steered to different directions $\phi_0$ are shown in FIG. 6.

It should be noted that the above two-microphone processing systems and methods described with reference to FIGS. 2A, 2B and 2C can to be used with three or more microphones in the following manner: from the three or more microphone signals, select two or more pairs of microphone signals from within said three or more microphone signals. For each pair of signals, perform the two-microphone direction estimation processing as above described in steps 320 and 330. The estimated direction of arrival for the three or more microphone signals is then obtained by combining the individual estimations obtained from some of the possible combinations of pairs of microphones, at each instance of time and at each sub-band. As a non-limiting example, such combination can be the selection of the pair yielding a diffuse-sound level estimation being the lowest of all pairs.

It should be also noted that the method 300 for generating the directional filter W is provided only as a specific example for purposes of illustration of some embodiments of the present invention, and it would be appreciated by those versed in the field, that alternative formulas may be devised within the scope of this invention for performing beam forming (e.g. gradient processing), and/or direction analysis, and/or filtering, without degrading the generality of this invention.

Generally, according to certain embodiments, the filtering technique of the present invention is applied directly to analogue sound input signals (e.g. $x_1(t)$, $x_2(t)$, t representing time). In these embodiments a system according to the invention is typically implemented by an analogue electronic circuit capable for receiving said analogue input signals performing the directional filter generation analogically and applying a suitable filtering to one of the input signals. Alternatively, according to some embodiments, the filtering technique of the present invention is applied to digitized input sound signals in which case the modules of the system can be implemented as either software or hardware modules.

In accordance with some embodiments of the present invention, the audio processing system may further include one or more of the following: additional filters, and/or gains, and/or digital delays, and/or all-pass filters.

It will also be understood that the systems (circuit/computer system) described throughout the specification may be implemented in computer software, a custom built computerized device, a standard (e.g. off the shelf computerized device) and any combination thereof. Likewise, some embodiments of the present invention may contemplate a computer program being readable by a computer for executing the method of the invention. Further embodiments of the present invention may further contemplate a machine-readable memory tangibly embodying a program of instructions executable by the machine for executing the method in accordance with some embodiments of the present invention.

While certain features of the invention have been illustrated and described herein, many modifications, substitutions, changes, and processing steps with similar results may be applied by those skilled in the art. It is, therefore, to be understood that the appended claims are intended to cover all such modifications and changes as fall within the true spirit of the invention.

The invention claimed is:

1. A system for use in filtering of an acoustic signal, the system comprising:

a filtration module and a filter generation module comprising a directional analysis module and filter construction module wherein:

said filter generation module is configured for receiving at least two input signals corresponding to an acoustic field;

said directional analysis module is configured to apply processing to analyze said at least two received input signals for determining directional data including data indicative of the amounts of direct and diffuse sounds in the analyzed signals, the direct and diffuse sounds having, respectively, relatively high correlation and relatively low correlation in the analyzed signals; and said filter construction module is configured to utilize data indicative of predetermined parameters of desired output directional response and of required attenuation of diffuse sound in an output signal for analyzing said directional data, and to generate output data indicative of operative parameters of said filtration module and;

said filtration module is configured to filter a certain input signal corresponding to said acoustic field based on said operative parameters and to produce an output acoustic signal corresponding to said desired output directional response and to said required attenuation of diffuse sound.

2. The system according to claim 1 wherein said filter generation module further comprises a beam forming module configured and operable for applying beam forming to said at least two input signals and for obtaining at least two acoustic beam signals corresponding to at least two different directional responses; and said directional analysis module being configured to apply said processing to said at least two acoustic beam signals for determining said directional data.

3. The system according to claim 2 wherein said beam forming module utilizes a delay and subtract technique.

4. The system according to claim 2 wherein said beam forming module is configured and operable for applying a magnitude correction filter to said acoustic beams signals.

5. The system according to claim 1 wherein said directional data is indicative of powers of direct and diffuse acoustic components in different portions of said analyzed signals and of directions from which said direct acoustic components originate.

6. The system according to claim 1 wherein said filter generation module is configured for processing different portions of said analyzed signals indicative of at least time and frequency portions of said analyzed signals; and said directional analysis module is configured for analyzing said different portions of said analyzed signals for obtaining powers of direct and diffuse acoustic components in said different portions of said analyzed signals and for obtaining directions from which said direct acoustic components originate.

7. The system according to claim 6 further comprising a time to spectra conversion module configured for decomposing said analyzed signals into frequency portions.

8. The system according to claim 7 wherein said time to spectra conversion module configured for dividing said analyzed signals into time frames.

9. The system according to claim 1, wherein said filter construction module is adapted for applying time smoothing to said data indicative of the operative parameters.

10. The system according to claim 1 wherein said filtration module is configured and operable for applying spectral modification to said certain input signal utilizing said operative parameters.

11. A method for use in filtering an acoustic signal, the method comprising:

providing data indicative of predetermined parameters of a desired output directional response and of a required attenuation of diffuse sound of the output signal to be obtained by the filtering;

receiving at least two different input signals corresponding to an acoustic field;

applying processing for analyzing said at least two received input signals to obtain directional data including data indicative of amounts of direct and diffuse sounds in the analyzed signals, the direct and diffuse sounds having, respectively, relatively high correlation and relatively low correlation in the analyzed signals;

utilizing said data indicative of predetermined parameters of the output directional response and of the required amount of diffuse sound of the output signal for analyzing said obtained directional data, and generating operative parameters for filtering a certain input signal corresponding to said acoustic field;

filtering said certain input signal using said operative parameters and thereby producing an output acoustic signal corresponding to said desired output directional response and the required attenuation of diffuse sound in the output signal.

12. The method according to claim 11 further comprising applying beam forming to said at least two input signals for obtaining at least two acoustic beam signals corresponding to at least two different directional responses.

13. The method of claim 12 wherein said applying of said beam forming comprising applying a magnitude correction filter to said acoustic beam signals.

14. The method according to claim 13 wherein said beam forming is performed utilizing a delay and subtract technique.

15. The method according to claim 14 comprising decomposing said analyzed signals into different portions being characterized by at least a time frame and frequency band parameters.

16. The method according to claim 15 wherein said directional data is indicative of powers of direct and diffuse acoustic components in different portions of said analyzed signals and of directions from which said direct acoustic components originate.

17. The method according to claim 11 wherein said filtering comprises spectral modification of said certain signal utilizing said operative parameters.

18. The method of claim 11, comprising converting said at least two input signals to a plurality of frequency bands, said processing being applied to each of the plurality of frequency bands for generating said directional data, said filtering, for generation of the output signal, comprises converting respective sub-bands of said certain signal to form a single signal in time-domain.

19. The method of claim 18, wherein the frequency bands are obtained by applying discrete Fourier-transform, said processing and said filtering being applied in the Fourier domain.

20. The method of claims 11, wherein said operative parameters are smoothed in time.

21. A program storage device readable by machine, tangibly embodying a program of instructions executable by the machine to perform method steps for use in filtering an acoustic signal, the method comprising:

providing data indicative of predetermined parameters of a desired output directional response and of a required attenuation of diffuse sound of the output signal to be obtained by the filtering;

receiving at least two different input signals corresponding to an acoustic field;

applying processing for analyzing said at least two received input signals to obtain directional data including data indicative of amounts of direct and diffuse sounds in the analyzed signals, the direct and diffuse sounds having, respectively, relatively high correlation and relatively low correlation in the analyzed signals; and utilizing said data indicative of predetermined parameters of the desired output directional response and of the required amount of diffuse sound of the output signal for analyzing said obtained directional data, and generating operative parameters for filtering a certain input signal corresponding to said acoustic field; and filtering said certain input signal using said operative parameters and thereby producing an output acoustic signal corresponding to the desired output directional response and the required attenuation of diffuse sound in the output signal.

22. A non-transitory computer readable storage medium storing a program executable by a computer for use in filtering an acoustic signal, the program comprising:

computer readable program code for causing the computer to provide data indicative of predetermined parameters of a desired output directional response and of a required attenuation of diffuse sound of the output signal to be obtained by the filtering;

computer readable program code for causing the computer to receive at least two different input signals corresponding to an acoustic field;

computer readable program code for causing the computer to apply processing for analyzing said at least two input signals to obtain directional data including data indicative of amounts of direct and diffuse sounds in the analyzed signals, the direct and diffuse sound having, respectively, relatively high correlation and relatively low correlation in the analyzed signals;

computer readable program code for causing the computer to utilize said data indicative of predetermined parameters of the output directional response and of the required amount of diffuse sound of the output signal for analyzing said obtained directional data, and generating operative parameters for filtering a certain input signal corresponding to said acoustic field; and computer readable program code for causing the computer to filter said certain input signal using said operative parameters and thereby produce an output acoustic signal corresponding to the desired output directional response and the required attenuation of diffuse sound in the output signal.

* * * * *